US010696079B2

(12) United States Patent
Franzke et al.

(10) Patent No.: US 10,696,079 B2
(45) Date of Patent: Jun. 30, 2020

(54) PRINTER DEVICE FOR THERMAL PRINTING OR EMBOSSING

(71) Applicant: Illinois Tool Works Inc., Glenview, IL (US)

(72) Inventors: Thomas Franzke, Würzburg (DE); Lars Schoberl, Burghaslach (DE); Stefan Balling, Würzburg (DE)

(73) Assignee: Illinois Tool Works Inc., Glenview, IL (US)

( * ) Notice: Subject to any disclaimer, the term of this patent is extended or adjusted under 35 U.S.C. 154(b) by 239 days.

(21) Appl. No.: 15/554,973

(22) PCT Filed: Mar. 22, 2016

(86) PCT No.: PCT/US2016/023588
§ 371 (c)(1),
(2) Date: Aug. 31, 2017

(87) PCT Pub. No.: WO2016/160422
PCT Pub. Date: Oct. 6, 2016

(65) Prior Publication Data

US 2018/0029399 A1 Feb. 1, 2018

(30) Foreign Application Priority Data

Mar. 27, 2015 (DE) ..... 10 2015 104 766

(51) Int. Cl.
*B41J 33/14* (2006.01)
*B41J 35/04* (2006.01)
(Continued)

(52) U.S. Cl.
CPC ..... *B41M 5/382* (2013.01); *B41F 19/02* (2013.01); *B41J 2/325* (2013.01); *B41J 35/08* (2013.01)

(58) Field of Classification Search
CPC ... B41J 35/08; B41J 35/04; B41J 35/02; B41J 35/03; B41J 35/28; B41J 33/14; B41M 5/382
(Continued)

(56) References Cited

U.S. PATENT DOCUMENTS 4,657,418 A 4/1987 Lahr
4,666,550 A * 5/1987 Spiers ..... A24C 5/583 118/221
(Continued)

FOREIGN PATENT DOCUMENTS

EP 0218500 A1 4/1987
EP 1538002 A2 6/2005
(Continued)

OTHER PUBLICATIONS

Search Report and Written Opinion for copending International Application No. PCT/US2016/023588, dated Jun. 22, 2016, 10 pages.
(Continued)

*Primary Examiner* — Leslie J Evanisko
(74) *Attorney, Agent, or Firm* — Christopher R. Carroll; The Small Patent Law Group LLC

(57) ABSTRACT

The invention relates to a printer device for thermal printing or embossing of a carrier film coated with a coloring matter on a substrate, wherein the printer device has a roller arrangement for accommodating the carrier film and for moving the carrier film along a conveyor path, stepper motors for driving the roller arrangement, a thermal print head for printing or embossing the coloring matter from the carrier film onto the substrate, and a swivel arrangement, which can be deflected over a swivel range, for engaging with a swivel roller of the roller arrangement and for exerting a tensile force on the carrier film. The printer device
(Continued)

is characterized in that, with regard to an engagement with the carrier film, the swivel roller is arranged along the conveyor path directly adjacent to the thermal print head.

17 Claims, 3 Drawing Sheets

(51) Int. Cl.
*B41J 35/08* (2006.01)
*B41M 5/382* (2006.01)
*B41J 2/325* (2006.01)
*B41F 19/02* (2006.01)

(58) Field of Classification Search
USPC ..... 400/247, 248, 208
See application file for complete search history.

(56) References Cited

U.S. PATENT DOCUMENTS 4,739,341 A * 4/1988 Matsuno ..... B41J 35/16 347/172
4,768,890 A * 9/1988 Makino ..... B41J 35/08 400/234
4,849,064 A 7/1989 Manusch et al.
4,909,648 A 3/1990 Hartman et al.
5,374,007 A 12/1994 Murison
5,433,539 A 7/1995 German
5,670,005 A 9/1997 Look et al.
5,873,662 A 2/1999 Clevinger
6,866,077 B2 3/2005 Zurmuhle et al.
7,052,194 B2 * 5/2006 Mills ..... B41J 17/36 242/344
2010/0172682 A1 * 7/2010 Hart ..... B41J 17/10 400/223
2013/0113870 A1 * 5/2013 Starkey ..... B41J 33/16 347/214

FOREIGN PATENT DOCUMENTS

WO 022371 A2 3/2002
WO 2007077482 A2 7/2007

OTHER PUBLICATIONS

International Preliminary Report on Patentability for copending international application No. PCT/US2016/023588, report dated Oct. 3, 2017 (6 pages).

* cited by examiner

PRINTER DEVICE FOR THERMAL PRINTING OR EMBOSSING

FIELD

The invention relates to a printer device for thermal printing or embossing.

BACKGROUND

Two known printing methods are thermal transfer printing and dye sublimation printing. These two printing methods are based on the basic principle that a carrier film coated with coloring matter is guided onto the medium to be printed and heated by means of a thermal print head. This thermal print head has a multiplicity of heating elements which can be individually heated and constitute individual image points—that is to say pixels—for this printing method. A heated heating element causes the coloring matter at the appropriate point on the carrier film to detach and to be absorbed by the medium to be printed—referred to as substrate—where, in turn, it solidifies. In other words, in such a printing operation, ink particles are released sectionally from the ink ribbon and transferred to the object to be printed.

In thermal transfer printing, the detachment of the coloring matter is effected in that the coloring matter is melted, whereas, in dye sublimation printing, the coloring matter is converted to a gaseous state. Controlled heating of the heating elements and detachment of the coloring matter from the carrier film enables any pattern or image to be produced on the medium to be printed.

A further known method provides that a carrier film coated with coloring matter—as described—is in turn guided onto the medium to be printed, however this time heated by means of a stamp-like printing plate, on which printing plate a contour corresponding to the required print image is permanently structured. Although, in this case, the whole stamp is heated, it only comes into contact with the carrier film at the contoured points, as a result of which ink particles are only transferred from the ink ribbon to the medium to be printed at these points. This method is also referred to as the hot embossing method and, with regard to its ink transfer mechanism, corresponds to thermal transfer printing and dye sublimation printing with the difference that the contour to be printed is permanently defined by the form of the stamp.

BRIEF DESCRIPTION

In the context of this invention, in the following, the term "thermal printing" or "thermal printing or embossing" is in all cases intended to refer equally to thermal transfer printing, dye sublimation printing and the hot embossing method. Not intended is thermal direct printing, in which the medium to be printed is itself heat-sensitive and is directly heated. Accordingly, the term "thermal printing method" is likewise intended to refer to the thermal transfer printing method, the dye sublimation printing method and the hot embossing method.

Here, the above carrier film is regularly provided by an appropriate film magazine which can be arranged replaceably on a suitable printer device. At the same time, for the printing process, the carrier film is basically unwound from an unwind roller and wound up on a rewind roller, wherein a reversal of the movement direction, particularly from time to time, is also possible. Furthermore, in principle, the approaches of continuous printing—with a thermal print head which is stationary in the longitudinal direction of the carrier film—and intermittent printing—with a thermal print head which moves in the longitudinal direction of the carrier film—are known and can also be realized switchably in one and the same printer device.

An important aspect in such a thermal printing method is the drive of the above rollers and the adjustment of the tension of the carrier film. On the one hand, the carrier film must be accelerated and braked in a short time; on the other, if possible, the tension must vary in a relatively narrow tension range. Also playing a role in this aspect is that the unwind and rewind behavior of the rollers, with regard to a rotational movement of the rollers, changes considerably with the diameter of the carrier film located on the particular roller and this must therefore be taken into account accordingly.

At the same time, an approach in which the tension of the carrier film is determined purely by the control of the unwind roller and the rewind roller is disclosed in WO 02/22371 A2. Here, the two rollers are in each case controlled in push-pull mode by a stepper motor and the current tension is determined arithmetically based on an electrical measurement at the stepper motors, wherein, in turn, the tension is then regulated via the control of the stepper motors. This assumes that these electrical quantities are measured accurately.

A non-contact optical sensor is provided in order to measure the circumference of the carrier film on the rollers. Although this solution manages to regulate the tension for the carrier film without a tension roller, an optical sensor is subject to error in that its measuring quality can deteriorate, in particular due to the development of dust during operation.

U.S. Pat. No. 4,909,648 A, from which the present invention starts, discloses a printer device which comprises a rewind roller and an unwind roller for a carrier film. Here, the rewind roller is driven by a stepper motor. Further, spring-mounted tension rollers, which can be swiveled over a comparatively large range and thereby compensate for tensile force variations of the carrier film, are provided here. However this leads to the fact that the tensile force of the carrier film can also effectively vary over a large range.

Accordingly, the object of the invention consists in designing and developing a known printer device in such a way that the tensile force of the carrier film can be closely defined by mechanical means so that an appropriate regulation by the stepper motors becomes unnecessary.

With a printer device having a roller arrangement for accommodating a carrier film and for moving the carrier film along a conveyor path, stepper motors for driving the roller arrangement, a thermal print head for printing or embossing the coloring matter from the carrier film onto a substrate, and a swivel arrangement, which can be deflected over a swivel range for engaging with a swivel roller of the roller arrangement and for exerting a tensile force on the carrier film, the stated problem is solved by the swivel roller arranged along the conveyor path directly adjacent to the thermal print head.

Important is the knowledge that both the deflection and the deflection force of a swivel roller which is part of a swivel arrangement can be closely limited particularly effectively when this swivel roller—with regard to the engagement with the carrier film—is arranged immediately adjacent to the thermal print head. In other words, no other possibly permanently arranged deflector roller is provided between this swivel roller and the thermal print head. The swivel roller then responds with the necessary sensitivity to changes in the tensile force in the carrier film.

One embodiment provides for the exertion of a substantially constant tensile force due to the swivel arrangement. This has the advantage that the tensile force of the carrier film can always be defined in a narrow range by mechanical means, as a result of which the tensile force is then also known. However, compared with imposing the tensile force by controlling the unwind roller and the rewind roller, this has the disadvantage that the tensile force can no longer be variably adjusted by this control but is constantly imposed by mechanical means. In return, however, the control of the unwind and rewind roller and the design of the printer device and especially the film magazine is considerably simplified, namely in particular for the case where both the unwind roller and the rewind roller are each driven by a stepper motor.

One embodiment provides that the direction of the tensile force is substantially independent of the deflection. The sensitivity can be even further increased when the swivel roller deflects the carrier film by approximately 90° or more. Influencing and therefore changing this tensile force can further be prevented in that the above deflection is measured without contact.

Other embodiments relate to a special implementation of the proposed solution in which the swivel arrangement comprises a dancer arm. This approach allows a constructively particularly favorable embodiment.

BRIEF SUMMARY OF THE DRAWINGS

Further details, characteristics, objectives and advantages of the present invention are explained in more detail below with reference to the drawing of a preferred exemplary embodiment. In the drawing.

DETAILED DESCRIPTION

Figure 1:
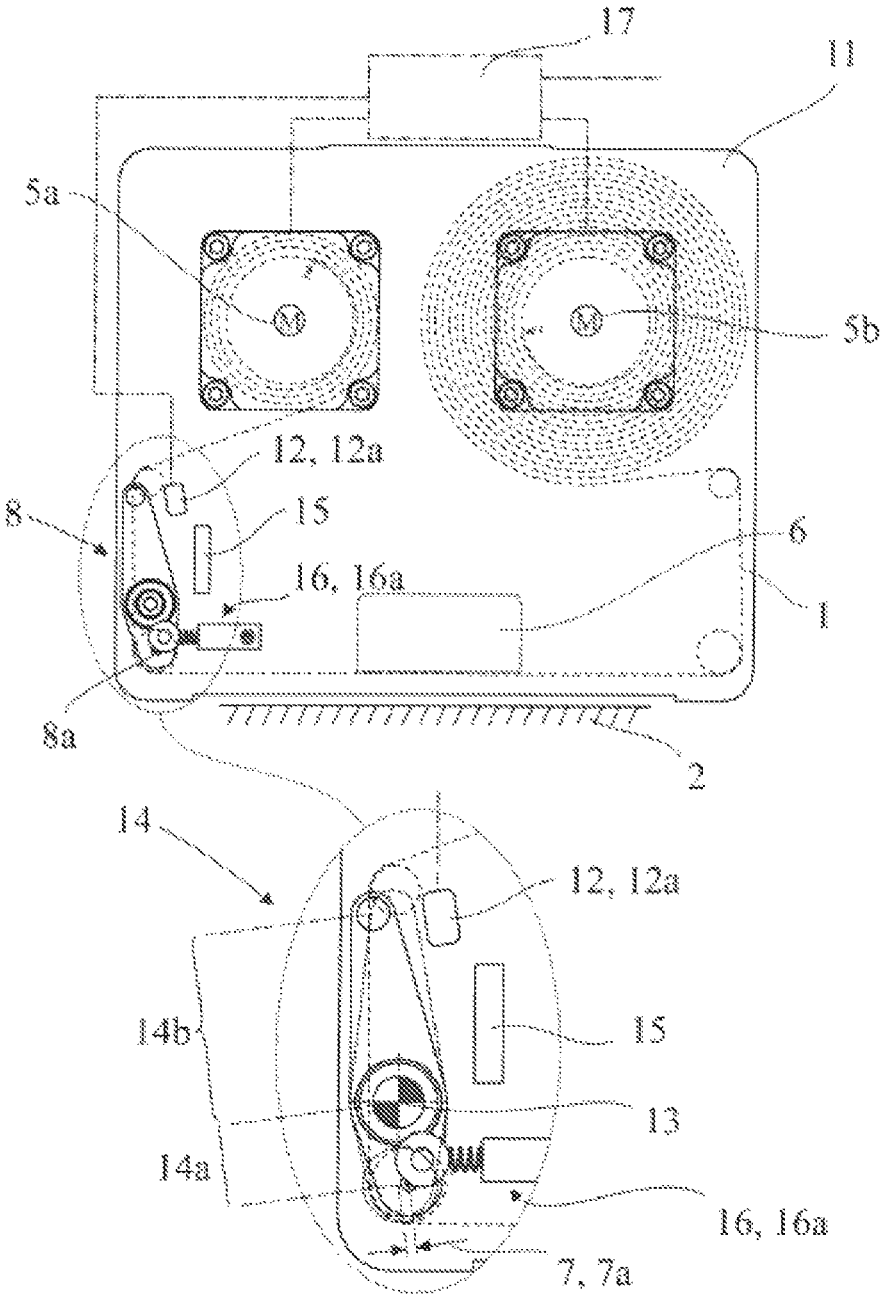
FIG. 1 shows a schematic front view of a proposed printer device in section.
Figure 2:
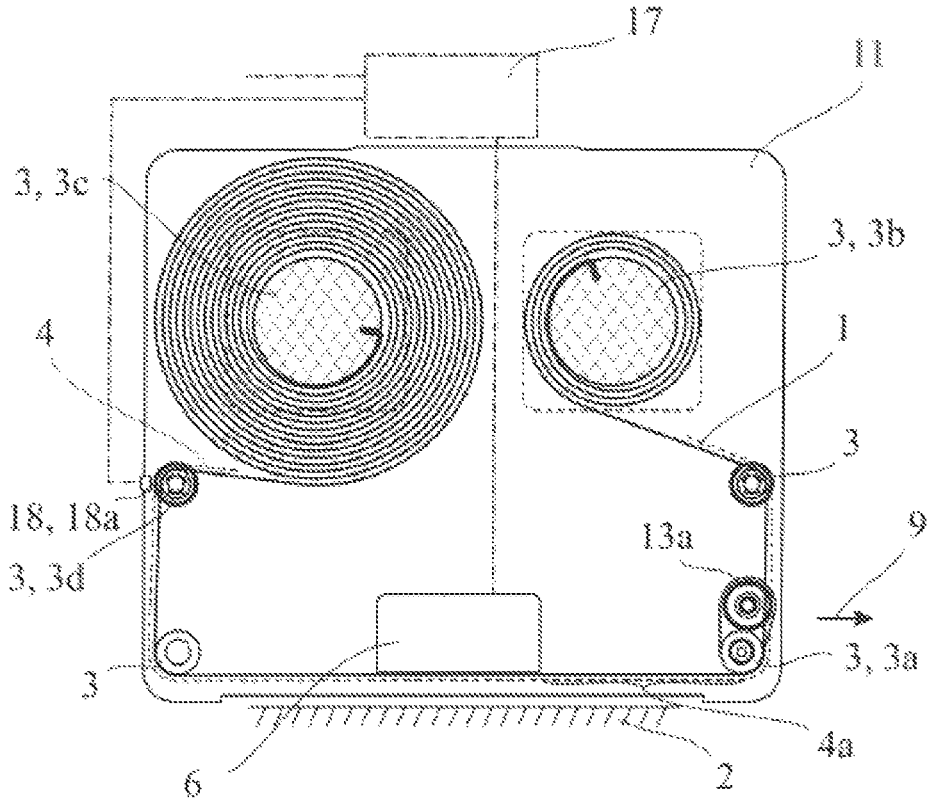
FIG. 2 shows a schematic rear view of the proposed printer device of FIG. 1 in section.
Figure 3:
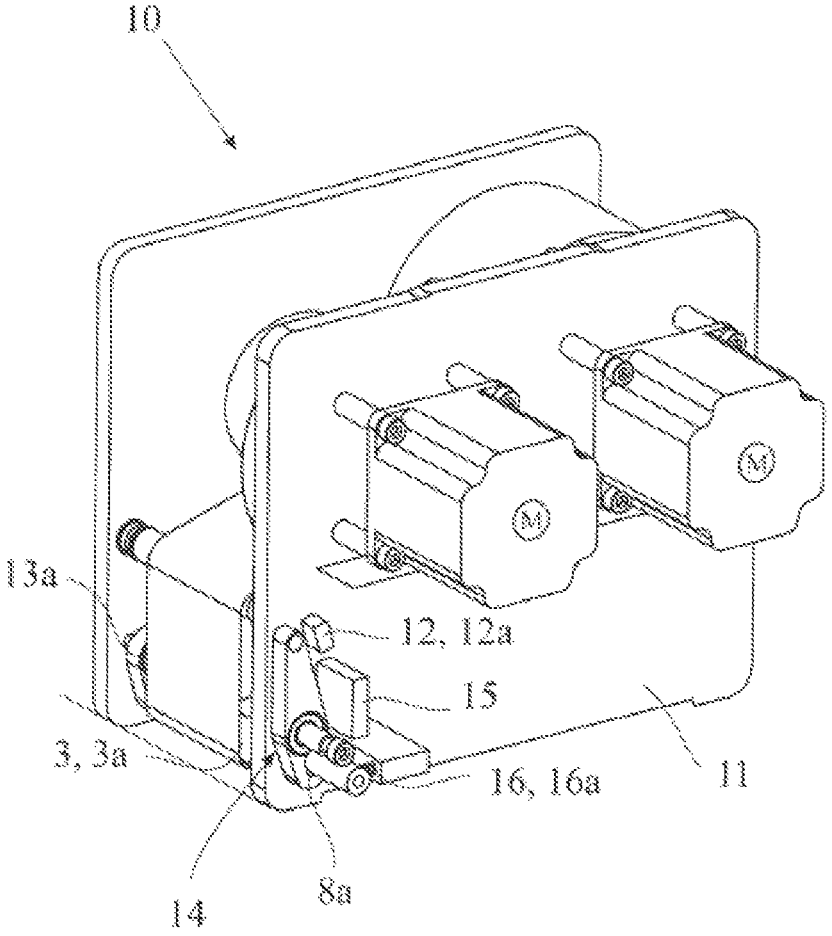
FIG. 3 shows a perspective view of the proposed printer arrangement of FIG. 1.

A proposed printer device for thermal printing or embossing of a carrier film 1 coated with a coloring matter on a substrate 2 is shown in a front view in FIG. 1 and in a rear view in FIG. 2, in each case schematically and in section. FIG. 3 shows a corresponding perspective view. Here, the designation as front or as rear view is in principle arbitrary. The carrier film 1 is a special kind of film for the thermal printing method which has preferably absorbed a coloring matter on one side. In a known manner, local heating of the carrier film 1 leads to a partial or complete detachment of the coloring matter from the carrier film 1 and to a corresponding deposit on the substrate 2.

The proposed printer device has a roller arrangement 3 for accommodating the carrier film 1 and for moving the carrier film 1 along a conveyor path 4, stepper motors 5*a, b* for driving the roller arrangement 3, a thermal print head 6 for printing or embossing the coloring matter from the carrier film 1 onto the substrate 2, and a swivel arrangement 8, which can be deflected over a swivel range 7, for engaging with a swivel roller 3*a* of the roller arrangement 3 and for exerting a tensile force on the carrier film 1. In particular, here, the swivel arrangement 8, which can be seen in FIG. 1, is rigidly connected at its swivel end 8*a*—with regard to the swivel movement—to the swivel roller 3*a*, as is clearly shown in FIG. 3.

The proposed printer device is now characterized in that, with regard to an engagement with the carrier film 1, the swivel roller 3*a* is arranged along the conveyor path 4 directly adjacent to the thermal print head 6. As can be seen from FIG. 3, no structure, and in particular no deflector roller, which is in engagement with the carrier film 1, is provided between the swivel roller 3*a* and the thermal print head 6.

Preferred, on the one hand, is that the swivel arrangement 8 exerts a substantially constant tensile force on the carrier film 1 over at least one part of the swivel range 7, preferably over the whole swivel range 7. Preferred, on the other hand, is also that the swivel arrangement 8 exerts a tensile force in a substantially constant tension direction 9 on the carrier film 1 over at least one part of the swivel range 7, preferably over the whole swivel range 7. As a result of this tensile force, a likewise substantially constant tensile force is imposed in the carrier film 1.

Attention is drawn to the fact that this condition is not fulfilled with arrangements having a tension roller for compensating and "buffering" changes in the tension of the carrier film 1. This is because, with such arrangements, the tension must be compensated by small changes in the deflection of the tension roller and corresponding change in the deflection force. Therefore, particularly in such cases and notwithstanding the printer device proposed here, it is required that the tensile force is not constant but rather variable.

According to the diagram in FIG. 2, it is further preferred that the swivel roller 3*a* deflects the carrier film 1 as a result of its engagement by at least substantially 90°. Here, the deflector roller 3*a* especially deflects the carrier film 1 by substantially 90°.

In order to enable the carrier film 1 to be replaced quickly, according to a preferred embodiment, it is provided that the printer device has a removable film magazine 10, which film magazine 10 encompasses the roller arrangement 3 and the carrier film 1. The film magazine 10 can be seen in the rear view of FIG. 2 and in the perspective view of FIG. 3. Here, it can also be seen that the film magazine 10 is fixed to a base plate 11 of the printer device and that the stepper motors 5*a, b* are fixed to the base plate 11 on a side of the base plate 11 opposite the film magazine 10. This side opposite the film magazine 10 is shown in FIG. 1, wherein the base plate 11 runs in the respective, here identical, planes of the diagram of FIG. 1 and FIG. 2. This relationship can be clearly seen from FIG. 3.

In order to measure the position of the swivel arrangement 8 in the swivel range 7, it is preferably provided that the printer device has a sensor arrangement 12, in particular for non-contact measurement of a deflection of the swivel arrangement 8. As in the exemplary embodiment shown, for this purpose, the sensor arrangement 12 can have a Hall sensor 12*a* for the non-contact measurement of the deflection.

Also as shown in FIG. 1, according to a preferred embodiment, with regard to the swivel arrangement 8, it can be provided that the swivel arrangement 8 has a dancer arm 14 which is elongated and mounted about a swivel point 13. Accordingly, the swivel roller 3*a* is then mounted about a roller swivel point 13*a*, which has a common swivel axis with the swivel point 13. Further, it is preferred that the swivel arrangement 8 engages with the roller arrangement 3 on an engagement side 14*a* of the dancer arm 14 with regard to the swivel point 13. It is preferred that the sensor arrangement 12 is set up to measure the deflection on a measuring side 14*b* of the dancer arm 14, which measuring side 14*b* lies opposite the engagement side 14*a*. In other words, the swivel point 13 divides the elongated dancer arm 14 into a section which forms the engagement side 14*a* and into a further section which forms the measuring side 14*b*.

With regard to the dancer arm 14, it is now preferably provided that, on the one hand, according to the exemplary embodiment, the dancer arm 14 is arranged on the side of the base plate 11 opposite the film magazine 10. In this way, the film magazine 10 can be replaced without risking damage to the often sensitive sensor arrangement 12.

On the other hand, it is likewise provided that the measuring side 14*b* of the dancer arm 14 covers a longer path than the engagement side 14*a* of the dancer arm when the swivel arrangement 8 swivels. In this way, the sensitivity of the sensor arrangement 12 for measuring even very small deflections of the swivel arrangement 8 is improved, thus enabling the tensile force exerted to be limited to a particularly narrow range. With a substantially straight dancer arm 14—as shown—this covering of a longer path can be achieved, for example, in that the measuring side 14*b* is longer than the engagement side 14*a*.

The tensile force can then be kept substantially constant, particularly with regard to magnitude and direction, when, as preferred, the swivel range 7 defines a substantially linear swivel path 7*a*, in particular of the dancer arm 14. Although the swivel arrangement 8 executes a rotary movement, a substantially linear swivel path 7*a* can be achieved by a limitation to short rotary movements. Preferably, at least one end stop 15, which limits the swivel range 7 to the substantially linear swivel path 7*a*, is provided.

Likewise, it is preferred that the swivel path 7*a* runs substantially along the conveyor path 4. In this way, the influence of the swivel process on the geometry of the conveyor path 4 is particularly small. Here, the swivel path 7*a* can also run substantially along a linear print section 4*a* of the conveyor path 4. A linear print section 4*a* in this sense is understood to be a section of the conveyor path 4 which, firstly, runs substantially linearly and which, secondly, is used, at any rate in an extension thereof, for thermal printing or embossing on the substrate 2 by engagement with the thermal print head 6. FIG. 1 illustrates this situation clearly. Here, it can be seen that the swivel path 7*a* is substantially shorter than the linear print section 4*a*, but runs parallel to and along the linear print section 4*a*.

It is preferred that the printer arrangement has a spring arrangement 16 connected to the swivel arrangement 8 for exerting the tensile force. This spring arrangement 16 can be seen in FIG. 1. The preferred variant, according to which the tensile force is aligned substantially collinearly with the swivel path 7*a*, can also be seen from FIG. 1. Preferably, the spring arrangement 16 comprises a wound torsion spring 16*a*.

Although the described measures already enable the tensile force exerted on the carrier film 1—and therefore also the tension in the carrier film 1—to be substantially constant and therefore not settable by the stepper motors 5*a, b*, regulation of the motors is still conceivable. Namely, it is preferred that the printer device has a motor regulator arrangement 17 for regulating a stepper motor speed of at least one of the stepper motors 5*a, b* during the movement of the carrier film 1. In this way, the speed, for example, with which the carrier film 1 is moved, can therefore be adjusted.

In this regard, it is further preferred that the roller arrangement 3 has an unwind roller 3*b* for unwinding the carrier film 1 and a rewind roller 3*c* for rewinding the carrier film. Basically, by reversing the direction of movement of the carrier film 1 along the conveyor path 4, the respective function of the unwind roller 3*b* and the rewind roller 3*c* can also be interchanged. Consequently, the appropriate arrangement can also be variable, in particular within a comparatively short period of time. In order to guarantee that the length of wound carrier film 1 corresponds to the length of unwound carrier film 1, it is advantageous when the motor regulator arrangement 17 only regulates the stepper motor speed of the stepper motor 5*a* to drive the unwind roller 3*b*. This means that regulation of the stepper motor speed of the stepper motor 5*b* to drive the rewind roller 3*c* does not occur. As therefore only one setpoint is provided instead of two setpoints, this enables the complexity of the regulator to be reduced. The speed of the stepper motor 5*b* can also be adjusted to stop the movement of the carrier film 1 or to set a different required set speed for this movement of the carrier film 1. According to this preferred embodiment, the stepper motor 5*a* is exclusively provided to drive the unwind roller 3*b* only for the above fine regulation by the motor regulator arrangement 17.

The ratio between the length of wound and unwound carrier film 1 and the rotational speed of the unwind roller 3*b* and the rewind roller 3*c* changes as a result of unwinding and rewinding the carrier film from the unwind roller 3*b* and the rewind roller 3*c*. In order to carry out an appropriate measurement, it is preferred that the printer device has a conveyor sensor arrangement 18 with a conveyor Hall sensor 18*a* for measuring a movement of the carrier film 1 by the roller arrangement 3. The roller sensor arrangement 3 can have a conveyor sensor deflector roller 3*d*, on which the conveyor sensor arrangement 18—as shown in FIG. 2 for example—is arranged. This enables an optical measurement which is subject to interference to be avoided.

The invention claimed is:

1. A printer device for thermal printing or embossing of a carrier film coated with a coloring matter on a substrate, the printer device comprising:

a roller arrangement for accommodating the carrier film and for moving the carrier film along a conveyor path;

stepper motors for driving the roller arrangement;

a thermal print head for printing or embossing the coloring matter from the carrier film onto the substrate;

a swivel arrangement that can be deflected over a swivel range, for engaging with a swivel roller of the roller arrangement and for exerting a tensile force on the carrier film;

a sensor arrangement for non-contact measurement of a deflection of the swivel arrangement, wherein, with regard to an engagement with the carrier film, the swivel roller is arranged along the conveyor path directly adjacent to the thermal print head, wherein the swivel arrangement has a dancer arm which is elongated and mounted about a swivel point, wherein the swivel arrangement engages with the roller arrangement on an engagement side of the dancer arm with regard to the swivel point, wherein the sensor arrangement is set up to measure the deflection on a measuring side of the dancer arm which lies opposite the engagement side, wherein the dancer arm is arranged on the side of a base plate of the printer device that is opposite a film magazine.

2. The printer device according to claim 1, wherein the swivel roller is arranged along the conveyor path directly adjacent to the thermal print head without another roller between the swivel roller and the thermal print head along the conveyor path.

3. The printer device according to claim 1, wherein the swivel arrangement exerts a substantially constant tensile force on the carrier film over at least one part of the swivel range.

4. The printer device according to claim 1, wherein the swivel arrangement exerts a tensile force in a substantially constant tension direction on the carrier film over at least one part of the swivel range.

5. The printer device according to claim 1, wherein the swivel roller deflects the carrier film as a result of its engagement by at least substantially 90°.

6. The printer device according to claim 1, further comprising a removable film magazine that encompasses the roller arrangement and the carrier film, wherein the film magazine is fixed to a base plate of the printer device and the stepper motors are fixed to the base plate on a side of the base plate opposite the film magazine.

7. The printer device according to claim 1, wherein the swivel range defines a substantially linear swivel path of the dancer arm.

8. The printer device according to claim 7, wherein the swivel path runs substantially along the conveyor path.

9. The printer device according to claim 8, wherein the swivel path runs substantially along a linear print section of the conveyor path.

10. The printer device according to claim 1, further comprising a spring arrangement connected to the swivel arrangement for exerting the tensile force.

11. The printer device according to claim 10, wherein the tensile force is aligned substantially collinearly with the swivel path.

12. The printer device according to claim 1, further comprising a motor regulator arrangement for regulating a stepper motor speed of at least one of the stepper motors during movement of the carrier film.

13. The printer device according to claim 12, wherein the roller arrangement has an unwind roller for unwinding the carrier film and a rewind roller for rewinding the carrier film.

14. The printer device according to claim 13, wherein the motor regulator arrangement only regulates the stepper motor speed of the stepper motor to drive the unwind roller.

15. The printer device according to claim 1, further comprising a conveyor sensor arrangement with a conveyor Hall sensor for measuring a movement of the carrier film by the roller arrangement.

16. The printer device according to claim 1, wherein the sensor arrangement has a Hall sensor for the non-contact measurement of the deflection.

17. A printer device for thermal printing or embossing of a carrier film coated with a coloring matter on a substrate, the printer device comprising:

a roller arrangement for accommodating the carrier film and for moving the carrier film along a conveyor path;

stepper motors for driving the roller arrangement;

a thermal print head for printing or embossing the coloring matter from the carrier film onto the substrate;

a swivel arrangement that can be deflected over a swivel range, for engaging with a swivel roller of the roller arrangement and for exerting a tensile force on the carrier film;

a sensor arrangement for non-contact measurement of a deflection of the swivel arrangement, wherein, with regard to an engagement with the carrier film, the swivel roller is arranged along the conveyor path directly adjacent to the thermal print head, wherein the swivel arrangement has a dancer arm which is elongated and mounted about a swivel point, wherein the swivel arrangement engages with the roller arrangement on an engagement side of the dancer arm with regard to the swivel point, wherein the sensor arrangement is set up to measure the deflection on a measuring side of the dancer arm which lies opposite the engagement side, wherein the measuring side of the dancer arm covers a longer path than the engagement side of the dancer arm when the swivel arrangement swivels.

* * * * *